US005348034A

United States Patent [19]

Bulgatz

[11] Patent Number: 5,348,034

[45] Date of Patent: Sep. 20, 1994

[54] WIND RESISTANT UMBRELLA

[76] Inventor: Joseph Bulgatz, 109 Manhattan Ave., New York, N.Y. 10025

[21] Appl. No.: 83,549

[22] Filed: Jun. 28, 1993

[51] Int. Cl.[5] ..... A45B 13/00
[52] U.S. Cl. ..... 135/19.5; 135/20.1
[58] Field of Search ..... 135/19.5, 20.1, 20.3, 135/22, 25.2, 25.4, 33.2, 33.4, 33.7; 160/84.1 F, 134

[56] References Cited

U.S. PATENT DOCUMENTS

| | | | |
|---|---|---|---|
| 1,996,071 | 4/1935 | Kahn | 135/20.1 |
| 3,345,786 | 10/1967 | Buzzella et al. | 135/20.1 X |
| 3,386,455 | 6/1968 | O'Rear | 160/134 X |

*Primary Examiner*—Carl D. Friedman
*Assistant Examiner*—Creighton Smith
*Attorney, Agent, or Firm*—Kane, Dalsimer, Sullivan, Kurucz, Levy, Eisele and Richard

[57] ABSTRACT

A wind resistant umbrella comprises a fan-like canopy constructed of sheets of metal or synthetic polymeric resins, which is attached to a central supporting rod.

9 Claims, 1 Drawing Sheet

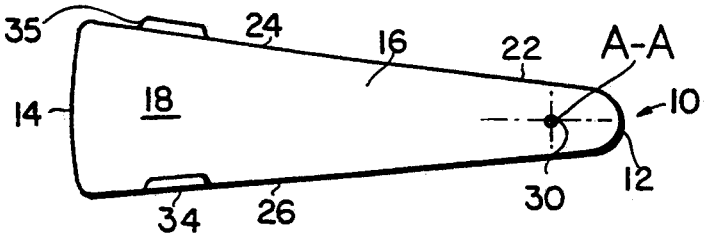
FIG. 1
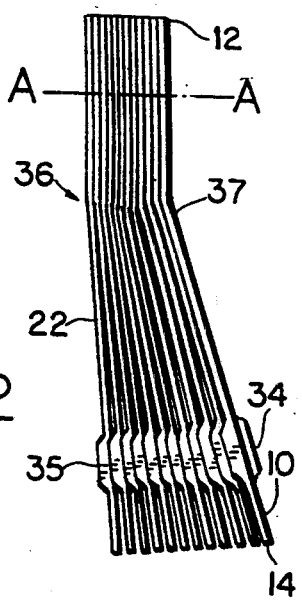
FIG. 2
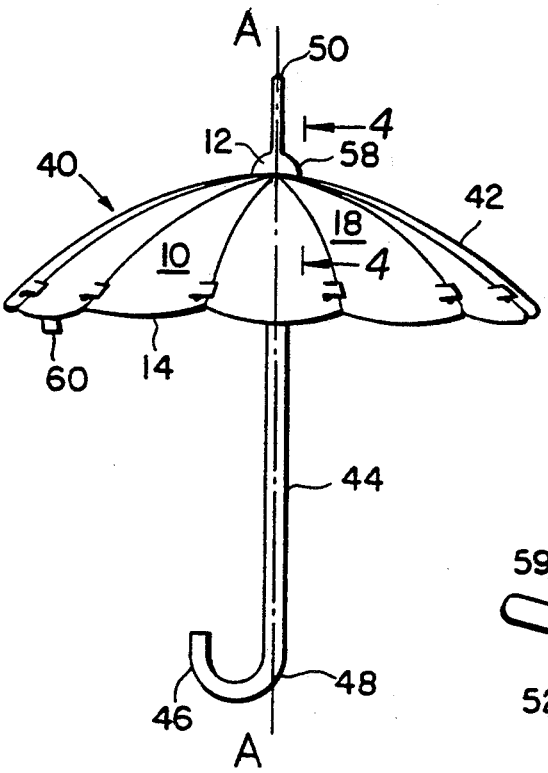
FIG. 3
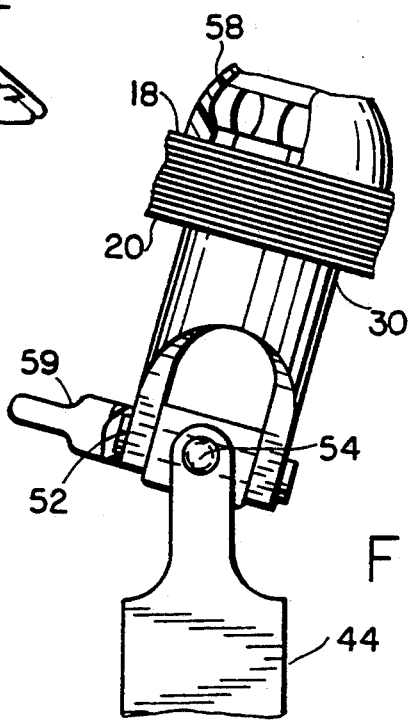
FIG. 4
FIG. 5
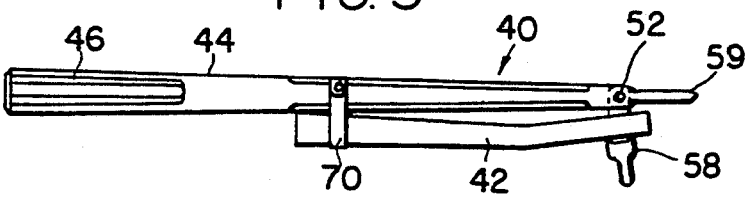
FIG. 6
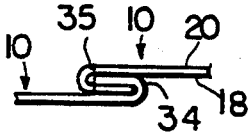

WIND RESISTANT UMBRELLA

BACKGROUND OF THE INVENTION

FIELD OF THE INVENTION

The invention relates to umbrellas and more particularly to an umbrella having a wind-resistant, collapsible canopy.

BRIEF DESCRIPTION OF RELATED ART

A sunshade consisting of a one-piece circular fan canopy on a central rod is described in the U.S. Pat. No. 238,365 issued Mar. 1, 1881. The construction is not suited for protection from wind, rain, snow, sleet or like weather conditions and likely would be damaged by such weather.

The U.S. Pat. No. 3,559,661 describes a wind-resistant umbrella which has a canopy of separate metal vanes supported by a folding frame. The frame collapses downwardly to fold the canopy vanes parallel to a central rod supporting member. The wind-resistance is due, to a great extent, to freedom of the vanes to lift and vent the canopy. When the vanes do lift, there is of course an opening of the canopy to penetration by the weather. The construction required of the folding support frame is relatively complex, in order to maintain canopy stability and prevent wind damage.

The umbrella of the present invention is simple in construction, yet it provides stability in the event of strong winds. The relatively simple construction is an economic and operating advantage.

SUMMARY OF THE INVENTION

The invention is of a wind resistant umbrella, which comprises;

A. a canopy, which comprises 1. a plurality of independent, elongate sheets assembled together movably in a vertical stack, each sheet having
   (a) a first end having a first predetermined width;
   (b) a second end having a second predetermined width;
   (c) a sheet body extending between the first and second ends;
   (d) a body upper surface;
   (e) a body lower surface;
   (f) a peripheral edge defining the outer boundary of the body and the first and second ends together, said peripheral edge including a leading edge and a trailing edge, said peripheral leading and trailing edges extending between the first and second ends at opposite outer boundaries of the body; and
   (g) an axial line perpendicular to the plane of the vertical stack, passing through a point adjacent to the first ends and distal to the second ends of the assembled sheets;

said assembled sheets being fixed together along the axial line, in a first position wherein the respective leading edges and trailing edges of the stacked sheets are in vertical alignment; a plurality of sheets in the first position being free to pivot around the axial line to a second position wherein the respective leading edges of each sheet adjacent to the second ends substantially covers the trailing edge of an adjacent sheet in the stack;

B. a rod positioned on the axial line, for supporting the canopy, and having
   (a) a first end adjacent to the first ends of the stacked sheets;
   (b) a second end distal to the first ends of the stacked sheets; and C. means for attaching the rod to the first ends of the stacked sheet assembly, whereby the sheets are movable between the first and second positions.

The umbrella of the present invention is relatively durable, being resistant to wind damage when in the uncollapsed, open canopy disposition. Other advantages of the umbrella of the invention will be described hereinafter.

BRIEF DESCRIPTION OF THE DRAWINGS

FIG. 1 is a view from above of a preferred sheet component for making up the canopy of the umbrella of the invention.

FIG. 2 is a side view of an assembled vertical stack of sheets as shown in FIG. 1, comprising the canopy of the invention in a collapsed position.

FIG. 3, is a side view of an embodiment umbrella of the invention, shown in an open canopy condition.

FIG. 4 is an enlarged view along line 4—4 of FIG. 3 showing in detail the attachment of the canopy to the supporting central rod.

FIG. 5 is a side view of the umbrella of FIG. 3, collapsed.

FIG. 6 is an enlarged view in cross-section of a portion of adjacent canopy panels used in the umbrella of FIG. 3, showing the connection between sheets.

DETAILED DESCRIPTION OF THE PREFERRED EMBODIMENTS OF THE INVENTION

Those skilled in the art will gain an appreciation of the invention from the following description of the preferred embodiments of the invention when read in conjunction with a viewing of the accompanying drawings of FIGS. 1–6, inclusive.

Referring first to FIG. 1, there is seen a view from above of a preferred sheet component 10 for making up the canopy of the umbrella of the invention. The sheet 10 is an elongate sheet having a first end 12 of a predetermined first width, and a second end 14 having a second predetermined width which is preferably wider than end 12. A sheet body 16 extends between the first and second ends 12,14, The body 16 has an upper surface 18 and a lower surface 20 (not seen in FIG. 1). A peripheral edge 22 defines the outer boundary of the body 16 together with ends 12,14, i.e.; the boundary of sheet 10 as seen from above. The peripheral edge 22 includes a leading edge 24 and a trailing edge 26, each of which extends between the first and second ends 12,14 at opposite outer boundaries of the body 16. The end 12 of sheet 10 includes an aperture 30 distal to end 14. Centered within the aperture 30 is an axial line A—A. The axial line A—A is perpendicular to the plane of sheet 10 which is a relatively thin sheet. For example, sheet 10 may have a thickness of from about 0.005 to 0.5 mm. The width and length of sheet 10 is not critical. Illustrative lengths are from about 12 to 30 inches. The width of end 12 may be about 1 to 3 inches and end 14 may be of a width whereby all of the sheets 10 in the open position form a closed circle. Sheet 10 may be fabricated from metal, such as aluminum, stainless steel and the like or from a molded synthetic polymeric resin such as, for example, polyvinylchloride, polyvinylalcohol, polycarbonate or the like. The metal and polymeric resin sheets 10 are inherently water-repellant and offer this advantage to the umbrella canopy without a need for chemical treatment to achieve water-repellency. However, sheets 10 may also be manufactured from heavy weight paper stocks when a disposable umbrella is desired. Chemical treatment of paper stock can achieve water repellency as known in the art. Fixed on the surface 18 of body 16 parallel to and proximate to the trail edge 26 is a stop flange 34. Opposite to stop flange 34 on the leading edge 24 is an "L" shaped flange 35 with the bottom of the "L" pointing downward. The flange 35 engages with and stops against flange 34 when the canopy 42 of the umbrella 10 is opened. This function will be described in more detail hereinafter.

Referring now to FIG. 2, there is seen a side view of an assembled vertical stack 36 of a plurality of sheets 10. The stack 36 comprises the canopy of the invention in a collapsed position. As shown in FIG. 2, the assembled sheets 10 are fixed together in the vertical stack 36, aligning the respective ends 12,14 and leading edge 24 and trailing edges 26, i.e.; the peripheral boundaries 22 of each sheet 10 are in vertical alignment with the respective peripheral boundaries 22 of adjacent sheets 10. The axial line A—A adjacent to ends 12 of the vertically stacked sheets 10 serves as a pivot point around which the individual and independent sheets 10 are pivotable when they are fixed together at axial line A—A. As shown in FIG. 2, the assembled sheets are in a vertical stack 36 referred to herein as a "first position". Each sheet 12 being free to pivot around the axial line A—A to a second position wherein the respective trailing edges 26 of each sheet 10 is brought to substantially cover the leading edge 24 of an adjacent sheet 10 within the stack. This second position, occurs when the canopy of the invention is in an open condition. A slight angular bend 37 in each sheet 10 (as seen in FIG. 2) angles the ends 14 downward when the canopy is opened as shown in FIG. 3. The open canopy 42 then assumes a partly hemispherical configuration as shown in FIG. 3. However, the angular bend 37 is not necessary and its elimination will give a flat, planar canopy 42 in the open disposition if that is desirable.

FIG. 3 is a side view of an embodiment umbrella 40 of the invention shown in an open canopy 42 condition. As shown in FIG. 3, a rod 44 having a handle means 46 on a second end 48 lies upon the axial line A—A with a first end 50 adjacent to the ends 12 of the vertically stacked sheets 10. Rod 44 supports the canopy 42 in both the open and closed positions. The sheet 10 upper and lower surfaces 18, 20 may be fabricated to be light-reflective as a safety feature, for use in dark areas or conditions such as when used while walking along a roadway. Preferably, alternate adjacent sheet 10 surfaces 18, 20 are of different colors or light-reflective qualities for enhanced visibility (again, as a safety feature).

FIG. 4 is an enlarged view along lines 4—4 of FIG. 3, showing in greater detail the attachment of the canopy 42 to the supporting central rod 44. A universal joint 52 fixed on the end 50 of rod 44 is connected to each of the stacked sheets 10 by pin 54. Each sheet 10 is thus held in sliding frictional engagement to joint 52 by pin 54 in aperture 30. The plurality of sheets 10 are held in attachment on the rod 44 by an upper ferrule 58 which is threadably engaged with and held on pin 54 in an immovable position respective to the stacked, vertical sheets 10. As can be seen from FIG. 4, the means of attaching rod 44 to the first ends 12 of stacked sheets 10 whereby the sheets are movable between the first and second positions is relatively simple and easy to manufacture. Unlike a conventional fabric umbrella, which requires support of the fabric panels with a finishing wire, a plurality of stretcher wires, a plurality of runner shafts and ribs; the umbrella of the present invention is free of these cumbersome support components. Use of the universal joint 52 permits some movement between the canopy 42 and rod 44. This acts as a shock absorber yielding when the canopy is hit by a gust of wind, absorbing what would otherwise be a damaging stress. The plurality of sheets 10 may be moved from the first and second positions with the assistance of a handle 60 (shown in FIG. 3). By traction along handle 60 the plurality of sheets 10 are fanned out to form the canopy 42. Movement of the first sheet 10 to which handle 60 is attached brings the stop flange 34 on the trailing edge 26 of the sheet 10 into engagement with the L-shaped stop flange 35 on leading edge 24 of an adjacent sheet 10, thereby stopping the first sheet in the fanned or second position. Each adjacent sheet 10 is similarly moved into the second position by traction of the preceding sheet 10 and the engagement of flange 34 until the canopy 42 is fully open. Advantageously, the bottom or last sheet 10 is fixed and not movable in position, to anchor the open canopy in the open position. When it is desired to collapse the canopy, traction on handle 60 in the opposite direction will bring the stacked sheets 10 into vertical alignment again as shown in FIG. 2.

The lower ferrule 59 functions to enable one to use the umbrella 40, in the closed canopy disposition, as a walking aid, protecting rod 44 and sheets 10 from damage through contact with the ground surface.

FIG. 5 is a fragmentary side view of a central rod 44 for use in the umbrella 40 of the invention. The attached canopy 42 in its closed condition will fold upon the rod 44 on universal joint 52. Conventional means of holding the stacked sheets 10 together in a stack 36 may be any employed in the art, including elastic bands, frictional clasps, Velcro straps 70 and the like.

Those skilled in the art will appreciate that many modifications may be made to the preferred embodiments described above without departing from the spirit and the scope of the invention. For example, the universal joint 52 illustrated in FIG. 4 is known in the art as a "Hooke's joint". However, any other form of a universal joint may be used such as a yoke and spider, a double yoke and spider, a four-bar conic linkage or their equivalents. Also, a dual or paired universal joints may be used or a ball and socket joint to provide movement or wind stress take-up in any direction. This greatly improves resistance to wind damage in gusts, particularly in conjunction with the movement of sheets 10 where they associate with adjacent sheets 10.

Also, as shown in FIG. 6, an enlarged cross-sectional side view of a portion of adjacent canopy panels or sheets 10 of the umbrella shown in FIG. 3, details of a preferred stop flange 34 and "L" shaped flange 35 are shown. Each flange 34, 35 is hook-shaped to engage with each other when the canopy 42 of the umbrella 10 of the invention is in an open condition. This sliding, removable engagement not only functions to stop the sheets 10 in the optimum open or second position described above, but secures adjacent sheets 10 together when the canopy 42 is open. This strengthens the canopy 42, resisting separation of the canopy during high winds, along the leading and trailing edges 24, 26, but permitting some air flow to reduce wind shocks.

What is claimed:

1. A wind resistant umbrella, which comprises;

A. a canopy, which comprises 1. a plurality of independent, elongate sheets assembled together movably in the plane of a vertical stack, each sheet having (a) a first end having a first predetermined width;

(b) a second end having a second predetermined width;

(c) a sheet body extending between the first and second ends;

(d) a body upper surface;

(e) a body lower surface;

(f) a peripheral edge defining the outer boundary of the body and the first and second ends together, said peripheral edge including a leading edge and a trailing edge, said peripheral leading and trailing edges extending between the first and second ends at opposite outer boundaries of the body; and (g) an axial line perpendicular to the plane of the vertical stack, passing through a point adjacent to the first ends and distal to the second ends of the assembled sheets;

said assembled sheets being fixed together along the axial line, in a first position wherein the respective leading edges and trailing edges of the stacked sheets are in substantial vertical alignment; a plurality of sheets in the first position being free to pivot around the axial line to a second position wherein the respective leading edges of each sheet adjacent the second ends substantially covers the trailing edge of an adjacent sheet in the stack;

B. a rod positioned on the axial line, for supporting the canopy, and having (a) a first end adjacent to the first ends of the stacked sheets;

(b) a second end distal to the first ends of the stacked sheets; and

C. means for attaching the rod to the first ends of the stacked sheet assembly, whereby the sheets are movable between the first and second positions; and D. handle means mounted on one of said sheets, for moving stacked sheets from the first to the second position.

2. The umbrella of claim 1, wherein the sheets are manufactured from metal.

3. The umbrella of claim 1 wherein the sheets are manufactured from a synthetic polymeric resin.

4. The umbrella of claim 1 wherein adjacent sheets are of different colors or light-reflective qualities.

5. The umbrella of claim 1 wherein sheets are fabricated from paper.

6. The umbrella of claim 1 wherein the sheets have light-reflective surfaces.

7. A wind resistant umbrella, which comprises;

A. a canopy, which comprises 1. a plurality of independent, elongate sheets assembled together movably in the plane of a vertical stack, each sheet having (a) a first end having a first predetermined width;

(b) a second end having a second predetermined width;

(c) a sheet body extending between the first and second ends;

(d) a body upper surface;

(e) a body lower surface;

(f) a peripheral edge defining the outer boundary of the body and the first and second ends together, said peripheral edge including a leading edge and a trailing edge, said peripheral leading and trailing edges extending between the first and second ends at opposite outer boundaries of the body; and (g) an axial line perpendicular to the plane of the vertical stack, passing through a point adjacent to the first ends and distal to the second ends of the assembled sheets;

said assembled sheets being fixed together along the axial line, in a first position wherein the respective leading edges and trailing edges of the stacked sheets are in substantial vertical alignment; a plurality of sheets in the first position being free to pivot around the axial line to a second position wherein the respective leading edges of each sheet adjacent the second ends substantially covers the trailing edge of an adjacent sheet in the stack;

B. a rod positioned on the axial line, for supporting the canopy, and having (a) a first end adjacent to the first ends of the stacked sheets;

(b) a second end distal to the first ends of the stacked sheets; and

C. means for attaching the rod to the first ends of the stacked sheet assembly, whereby the sheets are movable between the first and second positions; and wherein the means for attaching the rod comprises a pin upon which a plurality of the sheets is free to pivot.

8. The umbrella of claim 7 wherein the means for attachment further comprises a universal joint between the pin and the rod.

9. The umbrella of claim 7 wherein the means for attachment further comprises a ball and socket joint.

* * * * *